US011692284B2

(12) United States Patent
Meinders et al.

(10) Patent No.: US 11,692,284 B2
(45) Date of Patent: Jul. 4, 2023

(54) TRILOBAL FILAMENTS AND SPINNERETS FOR PRODUCING THE SAME

(71) Applicant: Aladdin Manufacturing Corporation, Calhoun, GA (US)

(72) Inventors: Maarten Meinders, Dalton, GA (US); Paul Pustolski, Newark, DE (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 0 days.

(21) Appl. No.: 15/488,825

(22) Filed: Apr. 17, 2017

(65) Prior Publication Data

US 2018/0051393 A1 Feb. 22, 2018

Related U.S. Application Data

(60) Provisional application No. 62/376,698, filed on Aug. 18, 2016.

(51) Int. Cl.

| | |
|---|---|
| ***D01F 6/60*** | (2006.01) |
| ***D01D 5/253*** | (2006.01) |
| ***D01D 5/24*** | (2006.01) |

(52) U.S. Cl.

CPC ..... *D01D 5/253* (2013.01); *D01D 5/24* (2013.01); *D01F 6/60* (2013.01)

(58) Field of Classification Search

CPC ..... Y10T 428/2975
USPC ..... 428/398
See application file for complete search history.

(56) References Cited

U.S. PATENT DOCUMENTS 3,419,936 A 1/1969 Sims
3,493,459 A 2/1970 McIntosh et al.
3,558,420 A * 1/1971 Opfell ..... D01D 5/24 428/398
3,772,137 A * 11/1973 Tolliver ..... A47C 27/12 425/382.2
4,110,965 A 9/1978 Bradley et al.
4,279,053 A 7/1981 Payne et al.
(Continued)

FOREIGN PATENT DOCUMENTS

EP 0601372 A1 * 6/1994 ..... D01D 5/253
EP 0625219 B1 2/1998

OTHER PUBLICATIONS

BASF. "Ultramid® Grades in Extrusion." Aug. 2004. Available as: http://www.polyrob.net/files/adminpolyrob/fichaTecnica/basf/ultramidNylon6/Ultramidbrochure.pdf (Year: 2004).*
(Continued)

*Primary Examiner* — Marla D McConnell
*Assistant Examiner* — Kevin Worrell
(74) *Attorney, Agent, or Firm* — Meunier Carlin & Curfman LLC

(57) ABSTRACT

Various implementations include a filament that includes three lobes that extend from a central portion of the filament, and the central portion defines an axial void. Each lobe bulges outwardly at its proximal end adjacent the central portion and has edges that form a continuous concave curve toward its distal end relative to an axis A-A that extends through the distal end of the respective lobe and the central portion of the filament. Thus, a width of each lobe at the proximal end thereof is greater than a width of each lobe at or adjacent the distal end, and adjacent edges of adjacent lobes intersect each other at concave proximal ends of the adjacent edges.

16 Claims, 5 Drawing Sheets

(56) References Cited

U.S. PATENT DOCUMENTS 4,383,817 A 5/1983 Mirhej et al.
4,398,933 A 8/1983 Lecron et al.
4,648,830 A 3/1987 Peterson et al.
4,770,938 A 9/1988 Morrison et al.
5,108,838 A 4/1992 Tung et al.
5,125,818 A 6/1992 Yeh et al.
5,154,908 A 10/1992 Edie et al.
5,190,821 A 3/1993 Jackson et al.
5,208,106 A 5/1993 Tung et al.
5,208,107 A 5/1993 Yeh et al.
5,230,957 A 7/1993 Lin et al.
5,279,897 A 1/1994 Jackson et al.
5,322,736 A 6/1994 Peterson et al.
5,362,563 A 11/1994 Lin et al.
5,380,592 A 1/1995 Tung et al.
5,413,857 A 5/1995 Hagen et al.
5,462,802 A 10/1995 Tajiri et al.
5,486,417 A * 1/1996 Hagen ..... D01D 5/082 428/357
5,489,475 A 2/1996 Hagen et al.
5,512,367 A 4/1996 Hagen et al.
5,523,155 A 6/1996 Lin et al.
5,540,993 A 7/1996 Hernandez et al.
5,587,118 A 12/1996 Mallonee et al.
5,597,650 A 1/1997 Mallonee et al.
5,620,797 A 4/1997 Mallonee et al.
5,686,121 A 11/1997 Samuelson et al.
D410,554 S 6/1999 Guyton
5,922,462 A 7/1999 Kent et al.
5,932,346 A 8/1999 Kent et al.
5,948,528 A 9/1999 Helms et al.
5,985,193 A 11/1999 Newport et al.
6,017,478 A 1/2000 Kent et al.
D422,099 S 3/2000 Kracke
6,048,615 A * 4/2000 Lin ..... D01D 5/24 428/376
6,153,138 A * 11/2000 Helms, Jr. ..... D01D 5/253 264/147
6,162,382 A 12/2000 Kent et al.
6,395,392 B1 5/2002 Gownder et al.
6,458,726 B1 * 10/2002 Harrington ..... D01D 5/253 442/364
6,589,653 B2 7/2003 Lin
6,620,505 B1 9/2003 Koyanagi et al.
6,652,965 B2 11/2003 Merigold et al.
6,660,377 B2 12/2003 Bernaschek
6,673,442 B2 1/2004 Johnson et al.
6,673,450 B2 1/2004 Portus et al.
6,740,401 B1 5/2004 Nishimura et al.
6,803,102 B1 10/2004 Haggard et al.
6,939,608 B2 9/2005 Tung
6,958,188 B2 10/2005 Moorhead et al.
7,028,695 B2 4/2006 Montoli et al.
7,087,303 B2 8/2006 Tung
D549,360 S 8/2007 An
D550,864 S 9/2007 Hernandez, Jr.
7,883,772 B2 2/2011 Sharp et al.
7,968,480 B2 6/2011 Delattre et al.
7,981,226 B2 7/2011 Sharp et al.
7,998,577 B2 8/2011 Yost et al.
8,043,689 B2 10/2011 Weiser et al.
8,137,811 B2 3/2012 Dugan et al.
8,297,035 B2 10/2012 Tachibana et al.
8,420,556 B2 4/2013 Sharp et al.
D689,215 S 9/2013 Xue
2003/0096114 A1 5/2003 Chen et al.
2003/0119403 A1 6/2003 Willis et al.
2004/0147194 A1 * 7/2004 Willis ..... B01D 39/1623 442/337
2004/0170836 A1 * 9/2004 Bond ..... D01D 5/24 428/398
2005/0112373 A1 * 5/2005 Tung ..... D01D 5/24 428/364
2006/0008548 A1 1/2006 Tung
2007/0077427 A1 4/2007 Dugan et al.
2007/0128404 A1 6/2007 Tung et al.
2007/0207317 A1 9/2007 Willingham et al.
2008/0032579 A1 2/2008 Abed et al.
2010/0029161 A1 * 2/2010 Pourdeyhimi ..... D01D 5/0985 442/329
2010/0159186 A1 6/2010 Samuelson et al.
2011/0281057 A1 11/2011 Tung et al.
2011/0287210 A1 * 11/2011 Tung ..... D01D 4/02 428/85
2012/0128437 A1 5/2012 Weiser et al.
2012/0231207 A1 9/2012 Rock et al.
2012/0231690 A1 9/2012 Pourdeyhimi et al.
2012/0238982 A1 * 9/2012 Weisman ..... A61F 13/53747 604/370
2012/0289107 A1 11/2012 Beissinger et al.
2013/0029086 A1 1/2013 Samuelson et al.
2013/0029152 A1 1/2013 Samuelson et al.
2013/0059495 A1 3/2013 Dempster et al.
2013/0344331 A1 12/2013 Corn et al.
2014/0103556 A1 4/2014 Diaz de Leon et al.
2015/0275400 A1 10/2015 Tung et al.

OTHER PUBLICATIONS

IIT Delhi. "Classification of fibers and their general properties." Aug. 25, 2014. Available online: https://archive.nptel.ac.in/courses/116/102/116102026/# (Year: 2014).*
Antron. "Technical Bulletin: Modification Ratio." 2014. Available online: https://www.antron.jp/wp-content/themes/antron-2021/pdf/en/K02958_Technical_Bulletin_Modification_Ratio.pdf (Year: 2014).*
Antron. "Carpet and fiber glossary." 2007. Available Online: https://carpetswalltowall.com/wp-content/uploads/2012/08/K02505_Carpet_amp_Fiber_Glossary.pdf (Year: 2007).*
Non-Final Office Action in U.S. Design U.S. Appl. No. 29/583,406, dated Mar. 26, 2018, 7 pages.
Co-pending U.S. Design U.S. Appl. No. 29/583,406, filed Nov. 4, 2016.
Office Action issued for U.S. Appl. No. 16/430,411, dated Dec. 14, 2021.
Final Office Action in connection to U.S. Appl. No. 16/430,411, dated Jun. 14, 2022.

* cited by examiner

TRILOBAL FILAMENTS AND SPINNERETS FOR PRODUCING THE SAME

CROSS REFERENCE TO RELATED APPLICATIONS

This application claims priority to U.S. Provisional Patent Application No. 62/376,698, filed Aug. 18, 2016, entitled "Trilobal Filaments and Spinnerets for Producing the Same," which is herein incorporated by reference in its entirety.

BACKGROUND

FIG. 1 illustrates a prior art filament that has been used for soil hiding. The filament shown in FIG. 1 includes four holes and is square shaped. The holes refract light passing through the filament, which helps to hide dirt, but the luster of the filament dulls over time and looks chalky when exposed to higher temperatures.

Thus, there is a need in the art for an improved filament that has soil hiding properties and is robust.

BRIEF SUMMARY

Various implementations include a filament formed from a thermoplastic polymer. The filament includes three lobes that extend from a central portion of the filament, and each lobe has a proximal end adjacent the central portion and a distal end radially spaced apart from the proximal end. The edges of each lobe between the proximal end and the distal end thereof define a continuous concave curve relative to an axis extending through the distal end of the respective lobe and the central portion of the filament. A width of each lobe is greatest at the proximal end thereof. Adjacent edges of adjacent lobes intersect each other at concave proximal ends of the adjacent edges, and the central portion defines an axial void.

In certain implementations, the void can be round or triangular. For example, in some implementations having a triangular shaped void, the void has concave shaped sides relative to a central axis extending axially through the void. In addition, in some implementations having a triangular shaped void, the vertices of the void extend toward the intersections of the adjacent edges of adjacent lobes.

In some implementations, lines tangential to adjacent edges of adjacent lobes at the proximal ends of the adjacent edges intersect at an angle of between 120° and 180°.

In some implementations, a line tangential to the tip of each lobe adjacent the distal end of the respective lobe and a line perpendicular to the axis extending through the distal end of the respective lobe and the central portion of the filament intersect at an angle of between 0° and 45°.

In some implementations, the filament has a first radius R1 that extends from a central axis of the filament to a geometric center of the distal end of one of the lobes and a second radius R2 that extends from the central axis of the filament to the intersection of adjacent edges of two adjacent lobes, and a ratio of the first radius R1 to the second radius R2 defines an external modification ratio (R1/R2) of between 2.0 and 2.5. In certain implementations, each distal end of each lobe has a tip radius R3, and a ratio of the first radius R1 to the tip radius R3 defines a first tip ratio (R1/R3) of between 0.17 and 0.27. And, in some implementations, a ratio of the second radius R2 to the tip radius R3 defines a second tip ratio (R2/R3) of between 0.4 and 0.6.

In some implementations, an area of the void is 2% to 3.5% of a cross-sectional area of the filament.

In some implementations, a modification ratio of the void is between 1.0 and 2.0.

In some implementations, the filament is 24 denier per filament.

In some implementations, the thermoplastic polymer comprises Nylon 6.

In some implementations, the relative viscosity of Nylon 6 is between 2.4 and 3.6.

Other implementations include a spinneret plate for producing filament. The spinneret plate includes one or more capillaries, and each capillary includes a substantially hexagonal shaped central area, an outer radial area that is radially spaced apart from the substantially hexagonal shaped central area, and legs that extend between the outer radial area and the substantially hexagonal shaped central area. The capillary defines three openings, and each opening is defined between the substantially hexagonal shaped central area, the outer radial area, and two adjacent legs. Each opening has a proximal end adjacent the substantially hexagonal shaped central area and a distal end adjacent the outer radial area, and the proximal end has a greater width than the distal end such that each opening has a substantially triangular shape.

In some implementations, the proximal end of each opening has a geometric center defined by an intersection of two adjacent sides of the substantially hexagonal shaped central area adjacent the opening.

In some implementations, the distal end of each opening has a rounded tip.

BRIEF DESCRIPTION OF THE DRAWINGS

Various implementations are explained in even greater detail in the following exemplary drawings. The drawings are merely exemplary to illustrate the structure of various devices and certain features that may be used singularly or in combination with other features. The invention should not be limited to the implementations shown.

DETAILED DESCRIPTION

Various implementations include a thermoplastic polymer filament that provides improved soil hiding without dulling the luster of the filament. In addition, the filament maintains its color over a wide temperature range and is durable. Such a filament may be useful in carpets or textiles, for example. In addition, various implementations include a spinneret plate that defines one or more capillaries for producing the filament.

Figure 1:
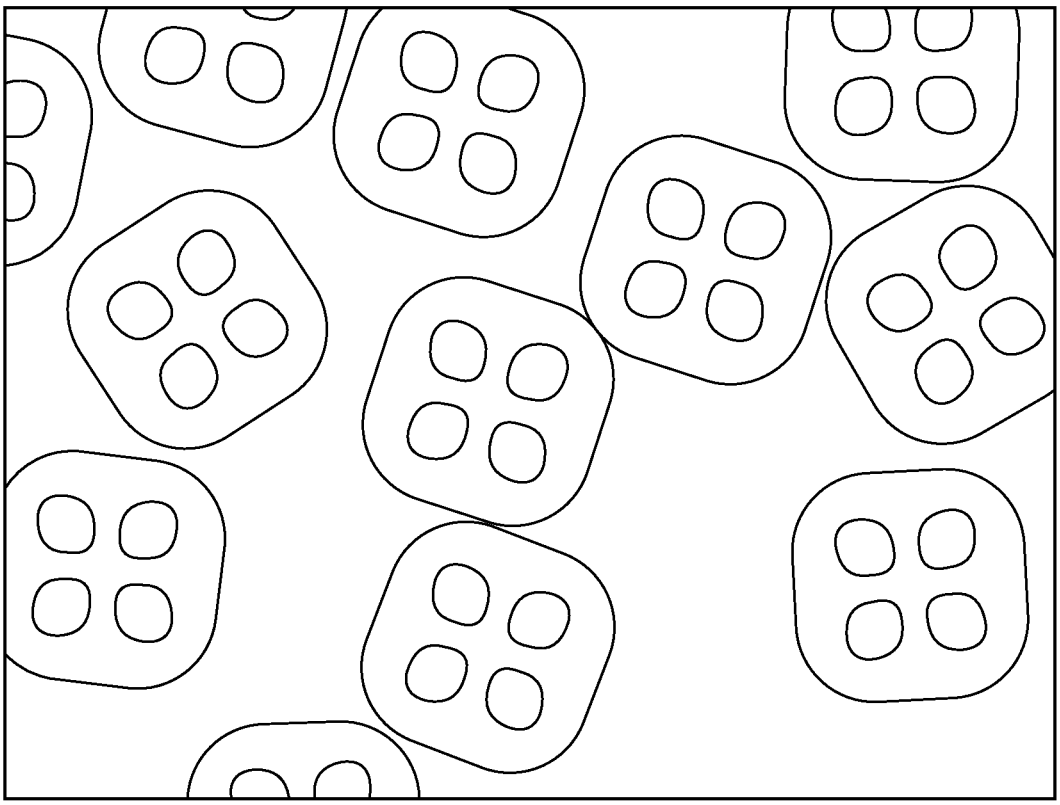
FIG. 1 PRIOR ART
FIG. 1 illustrates an end view of a filament in the prior art.
Figure 2:
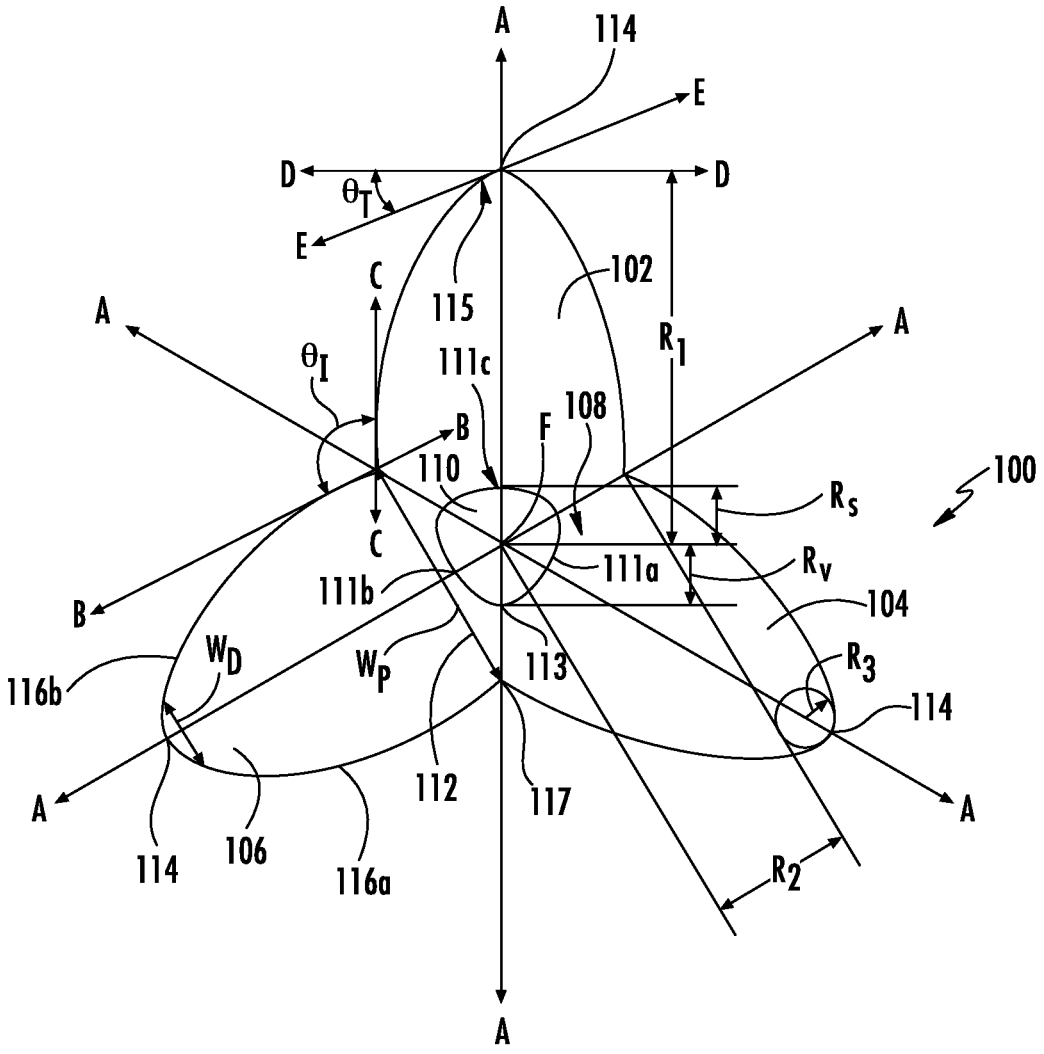
FIG. 2 illustrates an end view of a filament according to one implementation.

For example, FIG. 2 illustrates one implementation of a filament 100. The filament 100 includes three lobes 102, 104, 106 that extend from a central portion 108 of the filament 100, and the central portion 108 defines an axial void 110. Each lobe 102, 104, 106 bulges outwardly at its proximal end 112 adjacent the central portion 108 and has edges 116*a*, 116*b* that form a continuous concave curve toward its distal end 114 relative to an axis A-A that extends through the distal end 114 of the respective lobe 102, 104, 106 and the central portion 108 of the filament 100. Thus, a width WP of each lobe 102, 104, 106 at the proximal end 112 thereof is greater than a $W_D$ at or adjacent the distal end 114, and adjacent edges 116*a*, 116*b* of adjacent lobes intersect each other at concave proximal ends 117 of the adjacent edges 116*a*, 116*b*. An entire length of each edge 116*a*, 116*b* of each lobe 102, 104, 106 between the proximal end 112 and the distal end 114 defines a continuous concave curve relative to axis A-A. The filament 100, as shown in the end view of FIG. 2, has an outermost surface that is defined by the continuous concave curves of each edge 116*a*, 116*b* of each lobe 102, 104, 106. The edges 116*a*, 116*b* of each respective lobe 102,104,106 intersect at the distal ends 114 of the edges 116*a*,116*b*.

In addition, line B-B is tangential to edge 116*b* of lobe 106 at the proximal end 117 of the edge 116*b*, and line C-C is tangential to edge 116*a* of lobe 102 at the proximal end 117 of the edge 116*a*. Edge 116*b* of lobe 106 is adjacent edge 116*a* of lobe 102, and lines B-B and C-C intersect at an angle $\Theta_I$ of 120°. However, in other implementations, $\Theta_I$ is between 120° and 180°.

In addition, line D-D is perpendicular to the axis A-A that extends through the distal end 114 of lobe 102 and the central portion 108, and line E-E is tangential to a portion 115 of a tip portion of the lobe 102 adjacent the distal end 114 of lobe 102. Lines D-D and E-E intersect at an angle $\Theta_T$ of 30°. However, in other implementations, $\Theta_T$ is between 0° and 45°.

Furthermore, in the implementation shown in FIG. 2, the distal end 114 of each lobe is aligned with the intersection 117 of the other two lobes. In particular, line A-A extending through the distal end 114 of lobe 102 and central portion 108 extends through the intersection 117 of the adjacent edges 116*a*, 116*b* of adjacent lobes 104 and 106. Similarly, line A-A extending through the distal end 114 of lobe 104 and central portion 108 extends through the intersection 117 of adjacent edges 116*a*, 116*b* of adjacent lobes 102 and 106. And, line A-A extending through the distal end 114 of lobe 106 and central portion 108 extends through the intersection 117 of adjacent edges 116*a*, 116*b* of adjacent lobes 102 and 104. However, in other implementations, the lobes may not be equispaced about the central portion.

The filament 100 also has a radius R1 that extends from the central axis F of the filament 100 to the distal end 114 of any one of the lobes 102, 104, 106 and a second radius R2 that extends from the central axis F to the intersection of adjacent edges 116*a*, 116*b* of any two adjacent lobes 102, 104, 106. A ratio of the radius R1 to the radius R2 defines an external modification ratio (R1/R2) of between 2.0 and 2.5. For example, in one implementation, the external modification ratio is 2.2. In addition, each distal end 114 has a tip radius R3, and a ratio of the radius R1 to the tip radius R3 defines a first tip ratio (R1/R3) of between 0.17 and 0.27 (e.g., 0.21). A ratio of the radius R2 to the tip radius R3 defines a second tip ratio (R2/R3) of between 0.4 and 0.6 (e.g., 0.55).

In other implementations, the tip portion adjacent the distal end 114 of each lobe is non-circular shaped.

The void 110 shown in FIG. 2 has three concave shaped sides 111*a*, 111*b*, 111*c* relative to the central axis F that extends axially through the void 110. The sides 111*a-c* define an acorn or bulging triangular shape. In addition, vertices 113 of the void 110 are defined by each pair of intersecting sides 111*a*-111*c*, and each vertex 113 is aligned with the intersection 117 of the adjacent edges 116*a*, 116*b* of adjacent lobes 102, 104, 106 that is nearest the respective vertex 113 and the central axis F. In other implementations, the void 110 is round or triangular. The void 110 has three sides 111*a*, 111*b*, 111*c* that intersect at adjacent ends thereof. The entire length of each side 111*a*, 111*b*, 111*c* of the void 110 is arcuate and concave shaped relative to central axis F.

According to some implementations, an area of the void 110 is 2% to 3.5% of a cross sectional area of the filament 100. And, a modification ratio of the radius $R_V$ from the central axis F to one of the vertices 113 to the radius $R_S$ from the central axis F to a midpoint of one of the sides 111*a-c* ($R_V/R_S$) is between 1.0 and 2.0 (e.g., 1.5 to 2.0).

According to some implementations, the void 110 causes light to scatter when passing through the filament 100, which helps with hiding soil. In addition, the low external modification ratio of R1/R2 provides less surface area to which soil can cling and is durable.

Figure 3:
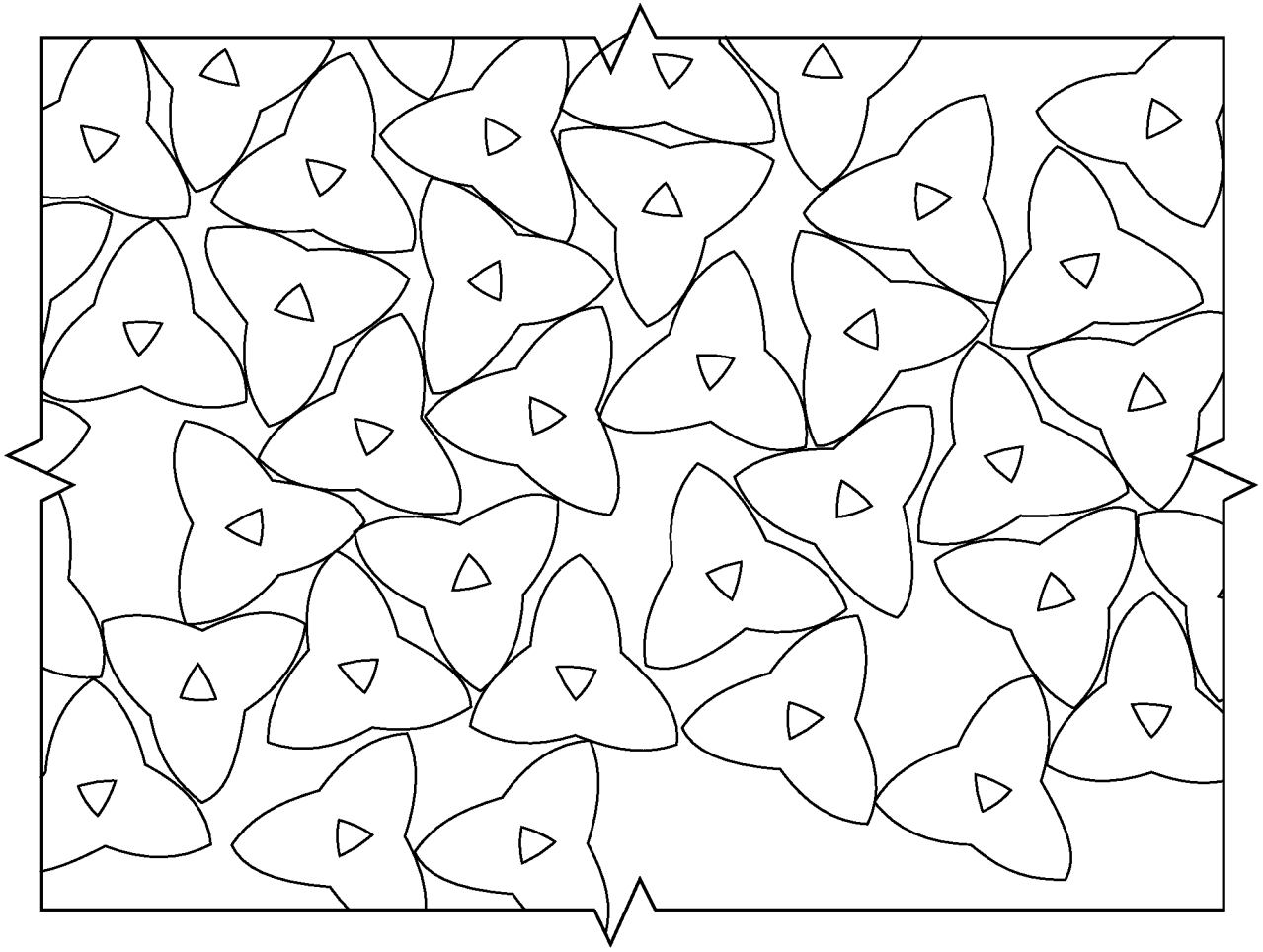
FIG. 3 illustrates an end view of a plurality of filaments, such as the filament shown in FIG. 2.

The thermoplastic polymer used to produce the filament 100 in FIGS. 2 and 3 includes Nylon 6, but other suitable thermoplastic polymers may be used in other implementations. For example, other exemplary polymers include Nylon 6,6, polyethylene terephthalate (PET), and polytrimethylene terephthalate (PTT). The relative viscosity of the nylon 6 is between 2.4 and 3.6. The filament 100 is at least 24 denier, but other implementations may have various other suitable deniers.

Figure 4:
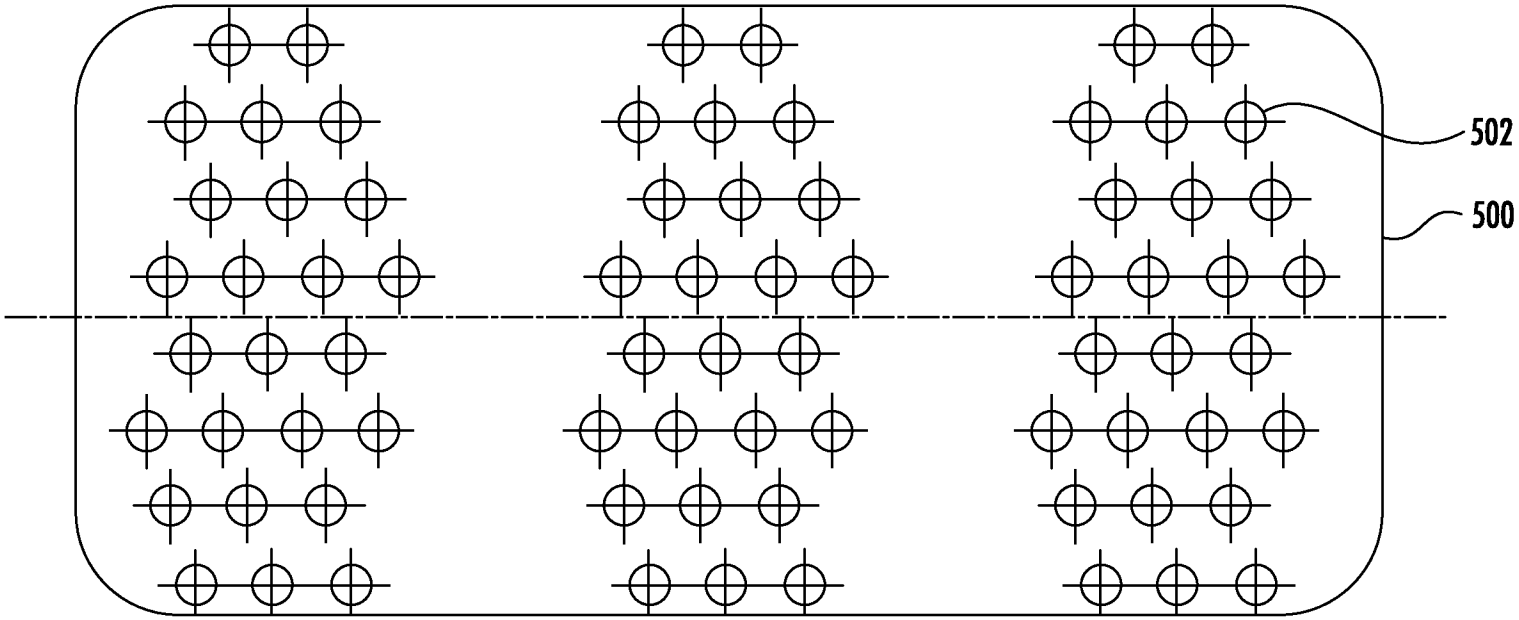
FIG. 4 illustrates a spinneret plate having a plurality of capillaries according to one implementation.
Figure 5:
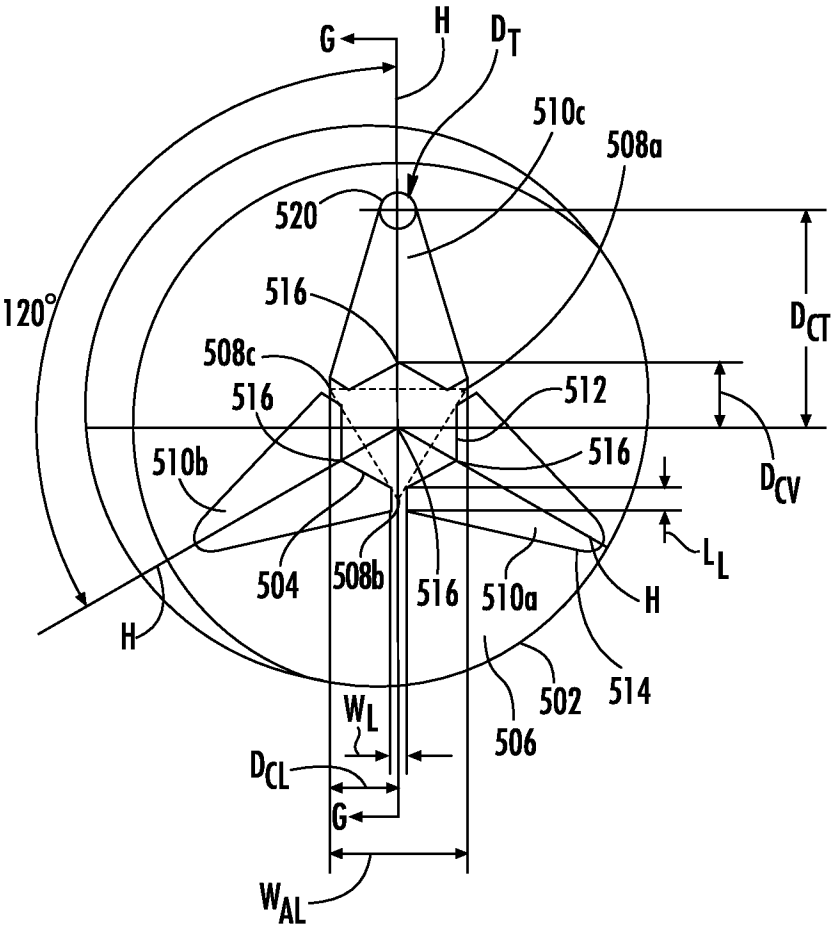
FIG. 5 illustrates an end view of one of the capillaries of the spinneret plate of FIG. 4.

Various implementations also include a spinneret plate for producing filament. FIG. 4 illustrates a spinneret plate 500 that includes a plurality of capillaries 502. FIG. 5 illustrates an end view of one capillary 502. As shown in FIG. 5, the capillary 502 includes a hexagonally shaped central area 504, an outer radial area 506 that is radially spaced apart from the hexagonally shaped central area 504, and legs 508*a*, 508*b*, 508*c* that extend between the outer radial area 506 and the hexagonally shaped central area 504. The capillary 502 defines three openings 510*a*, 510*b*, 510*c*, and each opening 510*a*, 510*b*, 510*c* is defined between the substantially hexagonal shaped central area 504, the outer radial area 506, and two adjacent legs 508*a*, 508*b*, 508*c*. Each opening 510*a*, 510*b*, 510*c* has a proximal end 512 adjacent the substantially hexagonal shaped central area 504 and a distal end 514 adjacent the outer radial area 506. The proximal end 512 has a greater width than the distal end 514 such that each opening 510*a*, 510*b*, 510*c* has a substantially triangular shape.

In addition, the proximal end 512 of each opening 510*a*, 510*b*, 510*c* has a geometric center 516 defined by an intersection of two adjacent sides of the substantially hexagonal shaped central area 504 adjacent the respective opening 510*a*, 510*b*, 51*c*.

The distal end 514 of each opening 510*a*, 510*b*, 510*c* has a rounded tip. For example, the rounded tip of each opening 510*a-c* may have a diameter $D_T$ of 0.16 mm. However, in other implementations, the tip may have a different diameter or be more pointed.

In the implementation shown in FIG. 5, the width $W_L$ of each leg 508*a*, 508*b*, 508*c* is 0.076 mm, the length $L_L$ of each leg 508*a*, 508*b*, 508*c* is 0.11 mm, the width $W_{AL}$ between outer ends of adjacent legs 508*a*, 508*b*, 508*c* is 0.67 mm, the distance $D_{CV}$ between the center 516 of the hexagonal area 504 and one of the vertices 518 of the hexagonal area 504 is 0.31 mm, the distance $D_{CL}$ between the center 516 and an outer end of one of the legs 508*a*, 508*b*, 508*c* is 0.34 mm, and the distance $D_{CT}$ between the center 516 and a proximal end 520 of a tip of one of the openings 510*a*, 510*b*, 510*c* is 1.05 mm. In addition, lines H-H extending through the distal end 514 of each opening 510*a*, 510*b*, 510*c* and the center 516 are 120° apart.

Figure 6:
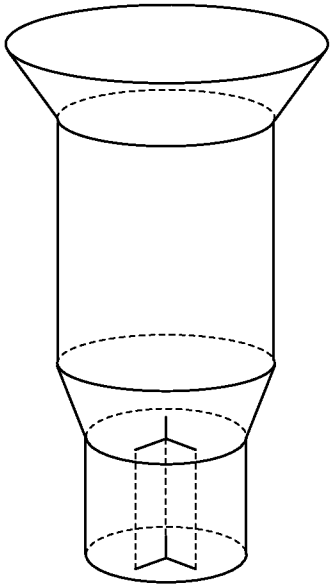
FIG. 6 illustrates a cross sectional view of the capillary in FIG. 5 taken along the G-G line.

FIG. 6 illustrates a cross sectional view of the capillary 502 shown in FIGS. 4 and 5 as viewed through the G-G line shown in FIG. 5. The capillary 502 is 6 mm deep, but in other implementations, this depth may be changed depending on the drawing speed and polymer being used.

The polymer exiting the end of the capillary 502 exits in three separate strands having the shape of the openings 510*a*, 510*b*, 510*c*, and each strand bulges radially outwardly such that the strands merge together, forming the intersection 117 of adjacent lobes 102, 104, 106 and the central portion 108 and void 110 of the filament 100 shown in FIG. 2.

In addition, the filament 100 may be a continuously drawn filament or may be a crimp and cut filament (e.g., to form staple fibers).

The terminology used herein is for the purpose of describing particular implementations only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While the foregoing description and drawings represent the preferred implementation of the present invention, it will be understood that various additions, modifications, combinations and/or substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. In addition, features described herein may be used singularly or in combination with other features. The presently disclosed implementations are, therefore, to be considered in all respects as illustrative and not restrictive, the scope of the invention being indicated by the appended claims and not limited to the foregoing description.

It will be appreciated by those skilled in the art that changes could be made to the implementations described above without departing from the broad inventive concept thereof. It is understood, therefore, that this invention is not limited to the particular implementations disclosed, but it is intended to cover modifications within the spirit and scope of the present invention, as defined by the following claims.

The invention claimed is:

1. A filament formed from a thermoplastic polymer, the filament comprising three lobes that extend from a central portion of the filament, each lobe comprising a proximal end adjacent the central portion and a distal end radially spaced apart from the proximal end of a respective lobe, and each lobe comprising first and second surfaces, wherein:

an entire length of each surface of each lobe extends between the proximal end and the distal end of the respective lobe, and the entire length of each surface defines a continuous concave curve as viewed from a plane extending through the distal end of the respective lobe and along an axially extending center line of the filament, distal ends of the surfaces of each respective lobe intersect at the distal end of the respective lobe, a width of each lobe is greatest at the proximal end of the respective lobe, adjacent surfaces of adjacent lobes define a corner at an intersection of proximal ends of the adjacent surfaces, and the overall filament, as viewed from an end view thereof, has an outermost surface that is defined by said surfaces of said lobes, and the central portion defines an axial void, wherein the void is triangular and has three sides that intersect at adjacent ends thereof, an entire length of each side of the void is arcuate and concave shaped as viewed from a central axis extending axially through the void, and wherein a cross-sectional area of the void is 2% to 3.5% of a cross-sectional area of the filament.

2. The filament of claim 1, wherein vertices of the void extend toward the corners defined by the adjacent surfaces of adjacent lobes at the intersections of the proximal ends of adjacent surfaces of adjacent lobes.

3. The filament of claim 1, wherein lines tangential to the proximal ends of adjacent surfaces defining each corner intersect at an angle of from 120° to less than 180°.

4. The filament of claim 1, wherein a line tangential to a tip portion of each lobe adjacent the distal end of the respective lobe and a line perpendicular to the plane extending through the distal end of the respective lobe and the axially extending center line of the filament intersect at an angle of 30°.

5. The filament of claim 1, wherein the filament has a first radius R1 that extends from a central axis of the filament to a geometric center of the distal end of one of the lobes and a second radius R2 that extends from the central axis of the filament to the intersection of adjacent surfaces of two adjacent lobes, and a ratio of the first radius R1 to the second radius R2 defines an external modification ratio (R1/R2) of between 2.0 and 2.5.

6. The filament of claim 1, wherein a modification ratio of the void is greater than 1.0 to 2.0, wherein the modification ratio is a ratio of a radius from a central axis of the void to a vertex of the void and a radius from the central axis of the void to a midpoint of a side of the void between adjacent vertices.

7. The filament of claim 1, wherein the filament is 24 denier per filament.

8. The filament of claim 1, wherein the thermoplastic polymer comprises Nylon 6.

9. The filament of claim 8, wherein a relative viscosity of Nylon 6 is between 2.4 and 3.6.

10. A filament formed from a thermoplastic polymer, the filament comprising three lobes that extend from an axial center of the filament, a first lobe comprising a first lobe proximal end adjacent the axial center and a first lobe distal end radially spaced apart from the proximal end, and the first lobe comprising first and second surfaces, and a second lobe comprising a second lobe proximal end adjacent the axial center and a second lobe distal end radially spaced apart from the proximal end, and the second lobe comprising third and fourth surfaces, wherein:

an entire length of each surface of the first lobe extends between the proximal end and the distal end of the first lobe, and the entire length of each surface defines a continuous concave curve as viewed from a plane perpendicular to an axial length of the filament, distal ends of the surfaces of the first lobe intersect in a tip portion at the distal end of the first lobe, a width of the first lobe is greatest at the proximal end of the first lobe and progressively decreases along a line from the proximal end of the first lobe to the distal end of the first lobe, the third surface of the second lobe adjacent to the first lobe defines a corner at an intersection of proximal ends of the adjacent surfaces, and a filament central portion adjacent the central axis defining an axial void, wherein the axial void is triangular and has three sides that intersect at adjacent ends thereof, an entire length of each side of the void is arcuate and concave shaped as viewed from the central axis extending through the plane, and wherein a cross-sectional area of the void is 2% to 3.5% of a cross-sectional area of the filament.

11. The filament of claim 10, wherein a first vertex of the void is along a line that extends away from the axial center towards the corner.

12. The filament of claim 10, wherein the corner comprises an angle of from 120° to less than 180°.

13. The filament of claim 10, wherein the tip portion terminates in a point.

14. The filament of claim 13, wherein a line along the tip portion of the first lobe tangential to the point of the tip portion of the first lobe and a line perpendicular to an axis line from the axial center of the filament to the point of the first lobe intersect at the point at an angle of 30°.

15. The filament of claim 10, wherein the filament has a first radius R1 that extends from the central axis of the filament to the point of the first lobe and a second radius R2 that extends from the central axis of the filament to the corner, and a ratio of the first radius R1 to the second radius R2 defines an external modification ratio (R1/R2) of between 2.0 and 2.5.

16. The filament of claim 10, wherein a modification ratio of the void is greater than 1.0 to 2.0, wherein the modification ratio is a ratio of a radius from the central axis to the vertex and a radius from the central axis of the void to a midpoint of a side adjacent the vertex.

* * * * *